US006318722B1

(12) United States Patent
Shafer

(10) Patent No.: US 6,318,722 B1
(45) Date of Patent: Nov. 20, 2001

(54) WORD PUZZLES AND GAMES

(76) Inventor: Timothy S. Shafer, 3019 E. Forest Lake Dr., Sarasota, FL (US) 34232

( * ) Notice: Subject to any disclaimer, the term of this patent is extended or adjusted under 35 U.S.C. 154(b) by 0 days.

(21) Appl. No.: 09/699,429

(22) Filed: Oct. 31, 2000

Related U.S. Application Data

(60) Provisional application No. 60/166,942, filed on Nov. 22, 1999.

(51) Int. Cl.[7] ..... A63F 9/18
(52) U.S. Cl. ..... 273/272; 273/429
(58) Field of Search ..... 273/272, 429, 273/430, 431, 432

(56) References Cited

U.S. PATENT DOCUMENTS 4,941,668 7/1990 Mobrem .
5,135,234 * 8/1992 Finch .
5,145,184 * 9/1992 Yearick et al. .
5,645,280 7/1997 Zelmer .
5,769,423 6/1998 Walker .
5,788,238 8/1998 LeBriton et al. .
5,813,672 9/1998 Loud, Jr. .
5,899,456 * 5/1999 Weinstock et al. .

OTHER PUBLICATIONS

"Anybody's Guess™, the Riotous Fame of Revealing Clues", Game Concept W.R. Karp & Co., 1990 Western Publishing Company, Inc.

* cited by examiner

*Primary Examiner*—William M. Pierce
(74) *Attorney, Agent, or Firm*—Oliff & Berridge, PLC

(57) ABSTRACT

A word puzzle game is provided for entertainment and/or educational use. The game includes at least one word puzzle. The word puzzle answer includes a plurality of words or phrases that are sequentially adjacent in a reference listing of all words or phrases from a given category. The puzzle also includes a plurality of clues. The game includes at least one clue-hiding device to selectively hide and reveal the clues and the answer of the puzzle. The game may also include a game board to measure the progress of players.

19 Claims, 6 Drawing Sheets

WORD PUZZLES AND GAMES

This nonprovisional application claims the benefit of U.S. Provisional Application No. 60/166,942 filed Nov. 22, 1999.

BACKGROUND OF THE INVENTION

1. Field of Invention

This invention relates to puzzles, such as word puzzles, and also to board-type games incorporating the word puzzles. The puzzles and/or games may be implemented electronically or non-electronically. The invention can be used for educational and/or entertainment purposes, for example.

2. Description of Related Art

Many word games, puzzles, and knowledge games are commonly known. It is not difficult to find puzzles or games involving:

a goal to be entertaining and educational;

the use of clues and clue-hiding devices;

the use of general knowledge or trivia or vocabulary;

the use of a game board to track progress;

the use of categories for words or information; and/or the use of timing devices.

SUMMARY OF THE INVENTION

The present invention provides an intriguing and challenging forum that has entertainment and educational value. In regards to educational value, it builds vocabulary, improves spelling, enhances general knowledge, and develops critical thinking skills.

According to one aspect of this invention, a sought-after solution (answer) of a particular word puzzle includes a plurality of sequentially adjacent words from a particular reference list. Therefore, a player(s) knows in advance that the answer is comprised of words that are adjacent to one another in a sequentially ordered list of all words from a given category. The sequential order may be alphabetical order, chronological order, or the like.

According to another aspect of this invention, a pictorial instruction is provided that instructs a player(s) how to proceed in a particular round of play. The pictorial instruction may comprise a picture that includes blocks, such as rectangular or other-shaped boxes, positionally corresponding to respective clues on a word puzzle. Particular blocks are marked, e.g. by shading, highlighting or the like, to designate that the positionally corresponding clues are to be revealed.

The present invention provides an enjoyable and effective game that tests and improves critical thinking, spelling, general knowledge, and vocabulary skills. Although adaptable to electronic media, such as a computer screen, a television screen, an electronic game board or the like, this invention may be implemented in a simple and easily-manufactured structure that is easy to understand and use, and which may be manufactured and sold at a relatively low cost.

The present invention provides a word puzzle game for entertainment and/or educational use. The game includes at least one word puzzle. The word puzzle answer includes a plurality of words or phrases that are sequentially adjacent in a reference listing of all words or phrases from a given category. The reference listing may possibly be, but is not limited to, alphabetical order, chronological order, as-published order, or a particular rank order. The puzzle also includes a plurality of clues. The clues may possibly be, but are not limited to, definitions, descriptions, specific characters of an answer word or phrase, and lengths, i.e., number of characters, of an answer word or phrase. The game includes at least one clue-hiding device that hides and reveals the clues and the answers of the puzzle. The game may also include a game board to measure the progress of the player(s). The game board may use a pictorial instruction technique, in which a picture includes blocks positionally corresponding to respective clues on the word puzzle. Particular ones of the blocks may be marked, e.g. by shading, highlighting or the like, to designate that the positionally corresponding clues are to be revealed The present invention also provides methods for playing a game involving such word puzzles.

BRIEF DESCRIPTION OF THE DRAWINGS

Exemplary embodiments are described below with reference to the drawings. In the drawings, like elements are depicted with like reference numerals.

DETAILED DESCRIPTION OF EXEMPLARY EMBODIMENTS

During the following description of exemplary embodiments of the present invention, for simplicity, the puzzle answers will be referred to as "words", rather than "words or phrases".

In the present invention, a word puzzle answer comprises a plurality of words that are sequentially adjacent in a reference listing of all words from a given category. The reference listing may be, but is not limited to, alphabetical order, chronological order, as-published order, or a particular rank order. That is, if the complete list of words from the given category was put into a specified order, such as alphabetical, chronological, as-published, rank, or the like, then the plurality of words of the answer, for example, three words, would be right next to each other in the list. For example, the second word of the answer should be the only word from the given category that would logically fit between the first and third word as ordered. Here are some examples:

| Category | Sample Answer |
|---|---|
| states of the U.S.A. (alphabetical) | Florida, Georgia, and Hawaii |
| familiar words (alphabetical) | point, poise, poison |
| books of the Bible (as-published) | Matthew, Mark, Luke |
| states of the U.S.A (ranked by size) | Alaska, Texas, California |
| U.S. presidents (chronological) | Nixon, Ford, Carter |

There are many excellent ways for a word puzzle of this invention to be displayed, including but not limited to: being printed onto paper, being projected onto a screen, being displayed with a hand-held LCD device, being shown on a television screen, and being displayed on a computer monitor or electronic game board.

In one exemplary embodiment, each word puzzle will be printed onto one side of an indicia-bearing substrate, such as a paper or plastic card. An exemplary printing format for a puzzle is shown in FIG. 1.

Figure 1:
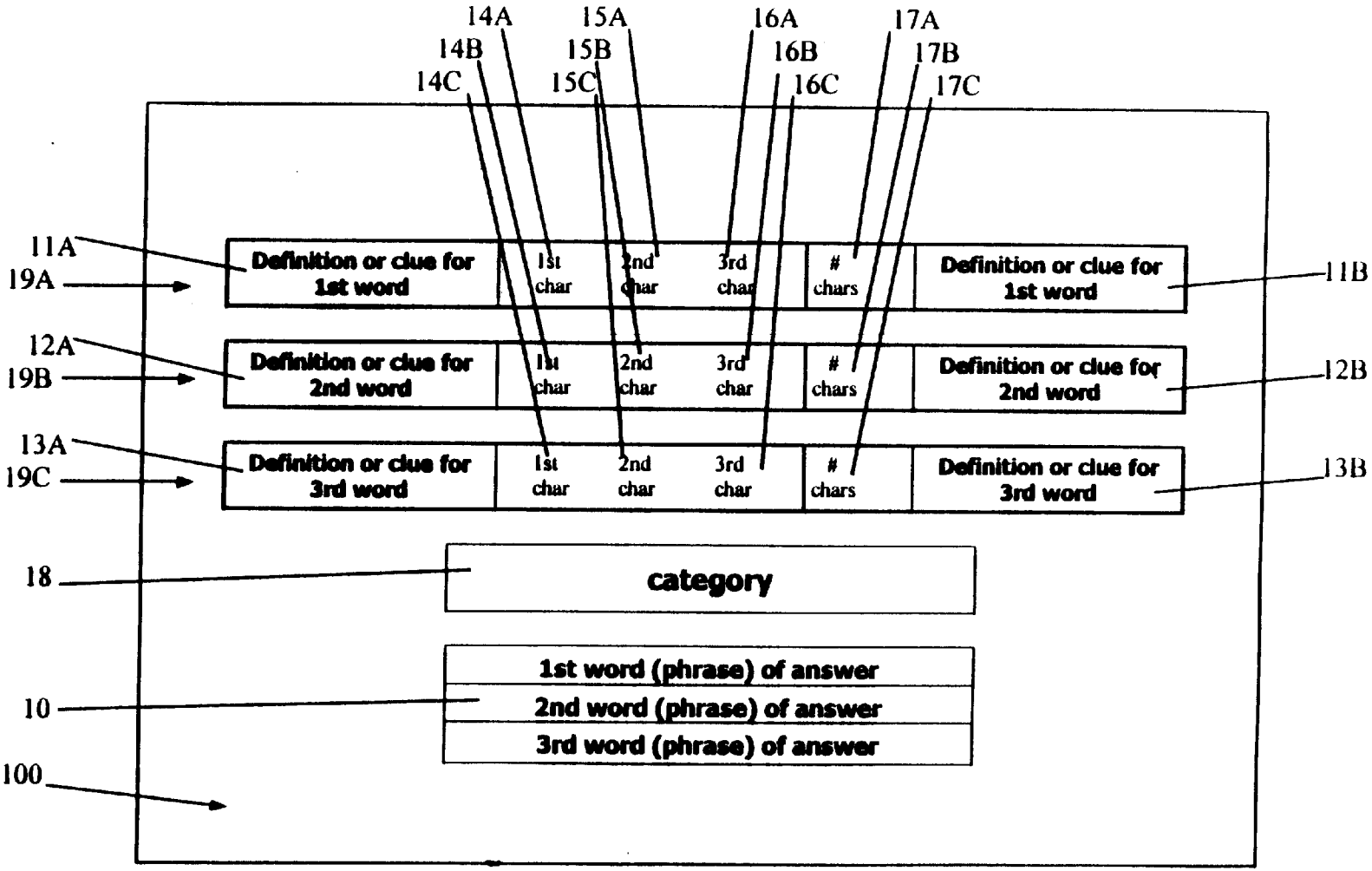
FIG. 1 shows a plan view of a skeleton format of a word puzzle of the present invention, and shows exemplary clue types and their arrangement.

In FIG. 1, an answer 10 comprising three words is at the bottom of a card 100, and the following clues are also contained:

- two definitions or descriptions 11A and 11B for the first word;
- two definitions or descriptions 12A and 12B for the second word;
- two definitions or descriptions 13A and 13B for the third word;
- clues 14A, 14B, and 14C respectively indicating the first letter of each word;
- clues 14A, 15B, and 15C respectively indicating the second letter of each word;
- clues 16A, 16B, and 16C respectively indicating the third letter of each word;
- clues 17A, 17B, & 17C respectively indicating the number of letters of each word; and
- clue 18 indicating the category for the answer.

Notice that except for the category, all of the clues for the first word in the answer are along the top line of text 19A, all of the clues for the second word are along the second line of text 19B, and all of the clues for the third word are along the third line of text 19C. This is not necessarily an essential feature of this invention, but, particularly in non-electronic embodiments of the invention, facilitates operation of a display apparatus, as will be described in detail below.

Figure 2:
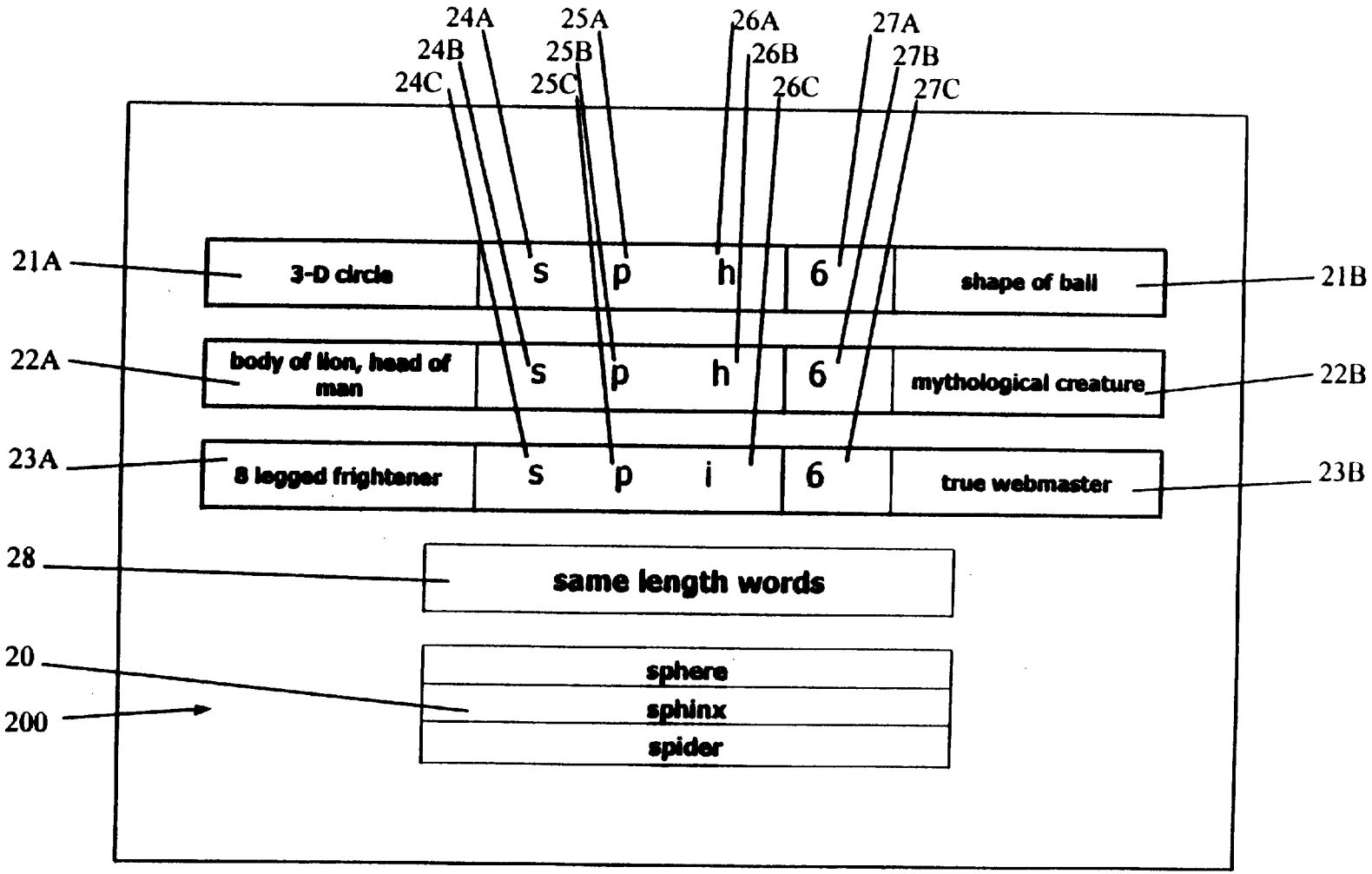
FIG. 2 shows a plan view of one exemplary word puzzle using the exemplary format of FIG. 1.

FIG. 2 shows an exemplary card 200 which uses the format of the skeleton format card 100 of FIG. 1. The answer 20, comprising three words in adjacent sequential order (in this case, adjacent alphabetical order), is at the bottom of the card, and the following specific clues are also contained:

- two definitions or descriptions 21A and 21B for the first word;
- two definitions or descriptions 22A and 22B for the second word;
- two definitions or descriptions 23A and 23B for the third word;
- clues 24A, 24B, and 24C respectively indicating the first letter of each word;
- clues 25A, 25B, and 25C respectively indicating the second letter of each word;
- clues 26A, 26B, and 26C respectively indicating the third letter of each word;
- clues 27A, 27B, and 27C respectively indicating the number of letters of each word; and
- clue 28 indicating the category for the answer.

Figure 3:
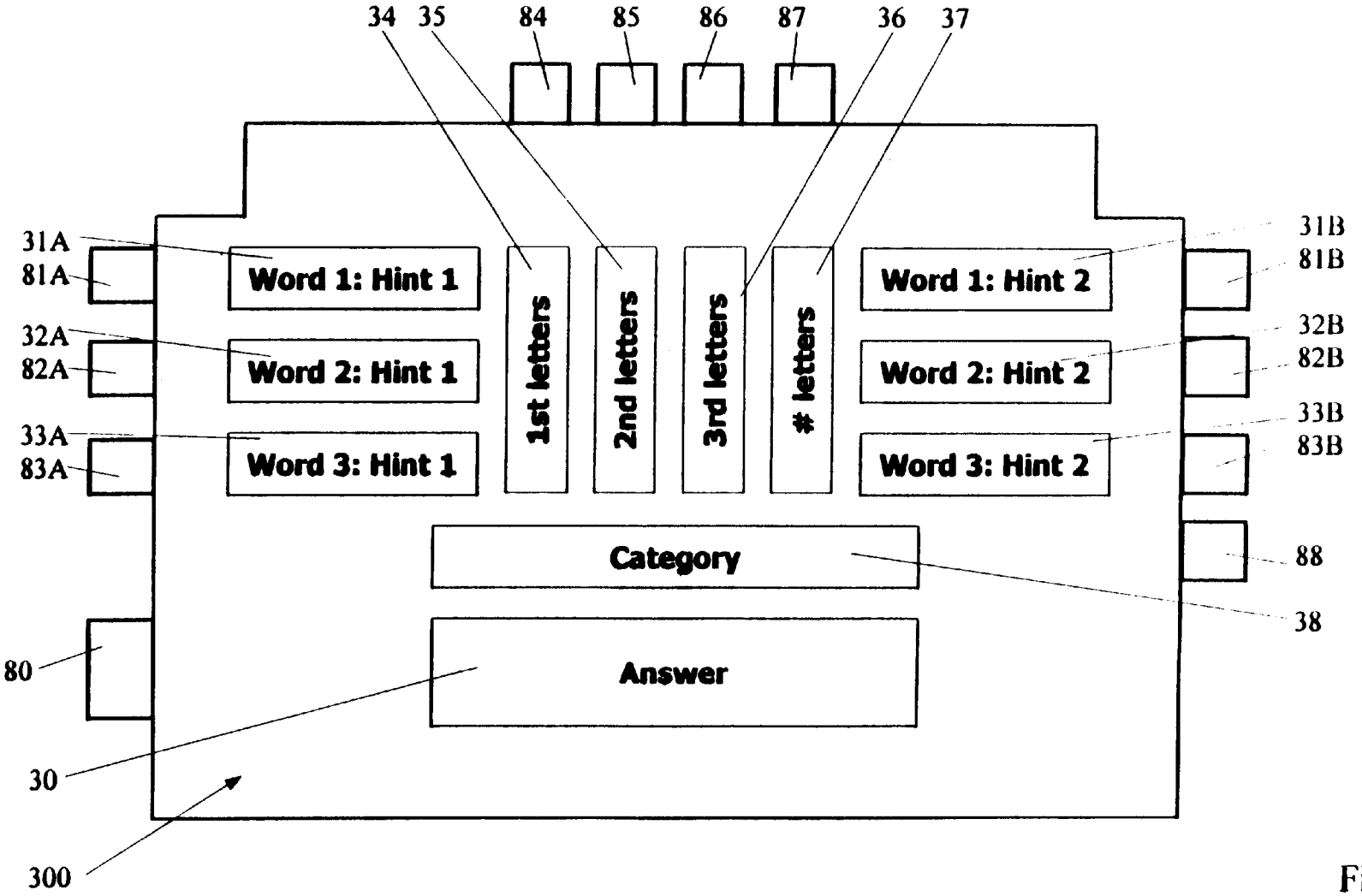
FIG. 3 shows a frontal view of an exemplary display apparatus by which the clues and answers of a word puzzle with the exemplary format of FIG. 1 can be selectively hidden and revealed.

FIG. 3 shows a frontal view of an exemplary display apparatus by which the clues and answers of a word puzzle with the exemplary format of FIG. 1 can be selectively hidden and revealed. In this exemplary embodiment, the display apparatus is a showcase box 300. The showcase box 300 interacts with puzzles having the format shown in FIG. 1, such as the word puzzle 200 shown in FIG. 2. The showcase box 300 may be made from paper, cardboard, metal, plastic and/or the like. Windows (described below) positionally corresponding to the clues and/or answers of a puzzle are fitted with clue-hiding devices (described below) that may be selectively opened to reveal or closed to mask the clues and/or answers.

In this embodiment, twelve windows are provided in the showcase box 300. Each window is able, independently, to be selectively opened to reveal or closed to hide the clues beneath. In particular:

- window 30 positionally corresponds to the answer 10 of FIG. 1;
- windows 31A and 31B positionally correspond to definitions or descriptions 11A and 11B relating to the first word;
- windows 32A and 32B positionally correspond to definitions or descriptions 12A and 12B relating to the second word;
- windows 33A and 33B positionally correspond to definitions or descriptions 13A and 13B relating to the third word;
- window 34 positionally corresponds to clues 14A, 14B and 14C that respectively indicate the first character of each word;
- window 35 positionally corresponds to clues 15A, 15B and 15C that respectively indicate the second character of each word;
- window 36 positionally corresponds to clues 16A, 16B and 16C that respectively indicate the third character of each word;
- window 37 positionally corresponds to clues 17A, 17B and 17C that respectively indicate the number of characters of each word; and
- window 38 positionally corresponds to clue 18 that indicates the category.

Clue-hiding devices are provided within the showcase device 300 in order to selectively open and close the windows. In this embodiment, the clue-hiding devices are slides acting like drawers. The slides are as follows:

- slide 80 selectively opens window 30;
- slides 81A and 81B selectively open windows 31A and 31B respectively;
- slides 82A and 82B selectively open windows 32A and 32B respectively;
- slides 83A and 83B selectively open windows 33A and 33B respectively;
- slide 84 selectively opens window 34;
- slide 85 selectively opens window 35;
- slide 86 selectively opens window 36;
- slide 87 selectively opens window 37; and
- slide 88 selectively opens window 38.

Figure 4:
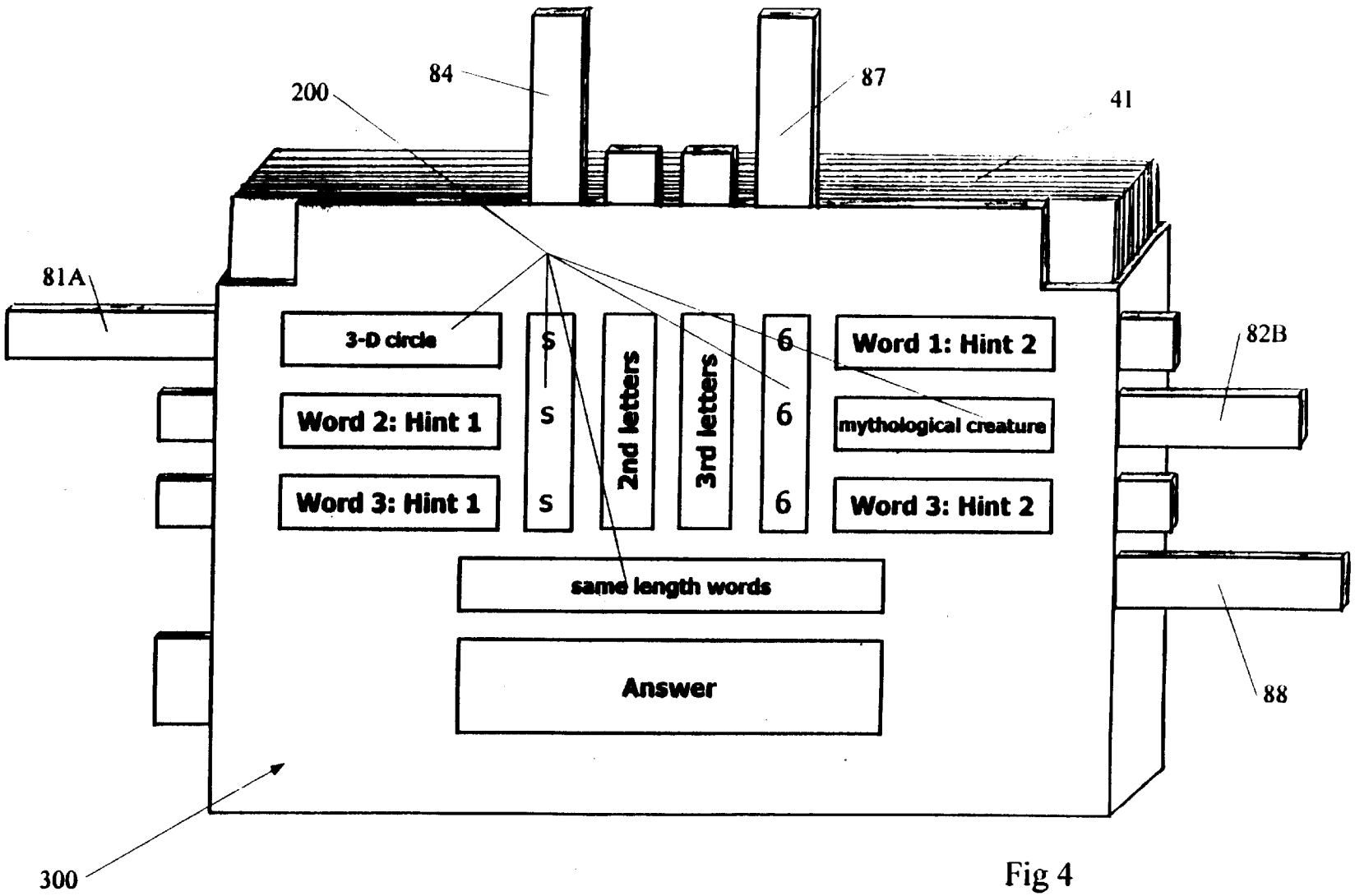
FIG. 4 shows a perspective view of the display apparatus of FIG. 3, with word puzzles stored inside, and with some clues revealed on a word puzzle being displayed.

FIG. 4 shows a perspective view of the showcase box 300. A stack of puzzle cards 41 is contained inside the showcase box 300. Each puzzle card 41 has the format of the skeleton format card 100 of FIG. 1. In FIG. 4, slides 81A, 82B, 84, 87, and 88 are shown in a pulled-out state, opening their associated windows. The card showing through the open windows (the top card) in FIG. 4 is the sample card 200 from FIG. 2.

An object of the word puzzle is to determine exactly the words of the answer. Playing alone, a player may try to figure the answer with only a certain number of clues open, or with a certain configuration of clues revealed. As a printed puzzle, only certain clues might be revealed, with solution attempts made without access to other clues.

An exemplary embodiment of a board game incorporating the above-described word puzzle is described below.

The game may be played by individual players or by teams. For simplicity, the description will refer to "players" rather than "players or teams."

Figure 5:
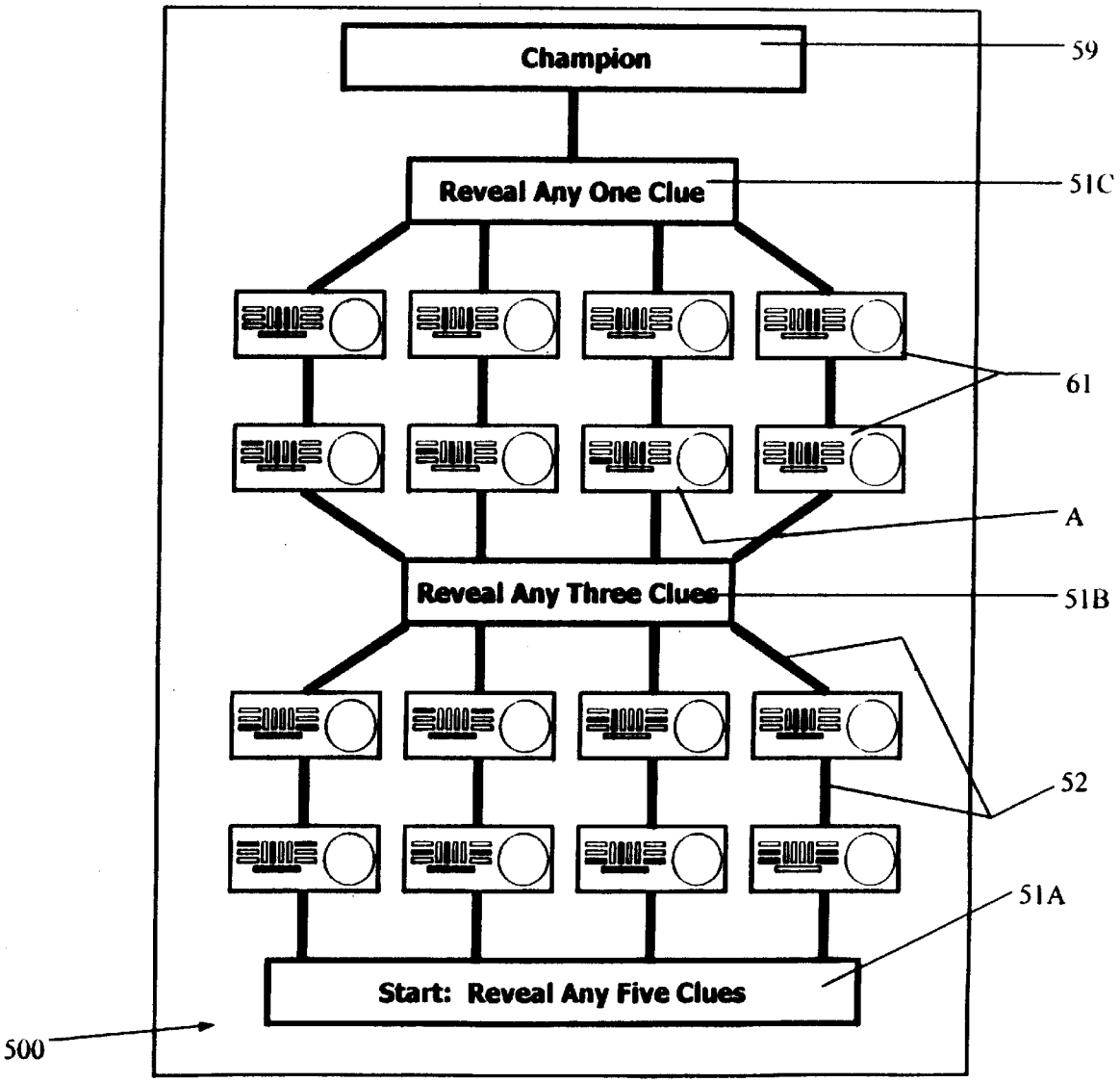
FIG. 5 shows a plan view of an exemplary game board.

FIG. 5 shows a game board including a START block 51A, intermediate instruction blocks 51B and 51C, progression paths 52, pictorial instruction blocks 61, and an END block 59. The END block 59 marks the end of the game, and is a target block which players compete to attain by successfully solving puzzles, as described below.

An exemplary set of instructions to play a game according to this invention is provided below, with reference to the above-described puzzle cards 41, showcase box 300 and game board 500.

Object and Scoring Method

In each round, each player tries to correctly identify all of the words of the word puzzle. A player can only guess once per puzzle, and he or she can only guess during his or her own turn. Each player begins by placing his or her playing piece, which may be any coin, pawn or other suitable object that is distinguishable from the playing pieces(s) of the other player(s), on the START block 51A of the game board 500 (FIG. 5). Whenever a player correctly guesses the answer on the word puzzle card, he or she advances his or her playing piece one position forward. He or she may move forward along any of the paths 52 that are attached to his or her current location. The first player to the END block 59 wins.

Preparing to Play

Place a stack of word puzzle cards 41 into the showcase box 300.

Playing a word puzzle round

Each round starts with the player whose position is one place clockwise from the player who started the previous round. In the first round, the starting player may be selected by rolling a die or by some other such mini-contest, or by mutual agreement among the players. The player to start should close each window on the showcase box 300, remove the front-most card, if the front-most card was used in a previous round or has been otherwise recently viewed by the players, and replace it at the back of the stack, or at some other arbitrary location within the stack. The next word puzzle card is thus positioned directly behind the front surface of the showcase box 300, and is ready for a new round.

A round is the set of turns taken in the attempt to solve one puzzle card (for example, card 200 of FIG. 2). Players take turns, with players successively revealing clues and potentially attempting to guess the puzzle answer. When clues are revealed, the showcase box might be moved and positioned best for the player taking the turn. However, other players should be allowed to see the new clue. Revealed clues should stay revealed for all to see for the remainder of the round.

Players' turns may proceed in a predetermined order, for example, a clockwise order, among the players. The round is completed when a correct guess has been made, or when every player has guessed incorrectly and no more clues remain.

Each round after the first round starts with, for example, the player who is seated next to, for example one place clockwise from, the player who started the previous round. Normally, a player should reveal no more than one clue during his or her turn. The exception is during the first turn of a round.

The First Turn of a Round

First, activate a timing device, such as a sand timer, a stopwatch or the like. This measures the maximum time allowed for the turn, which may, for example, be one minute. Then, the player follows the instructions on the game board in the block corresponding to where his or her game piece lies and reveals clues as indicated. For example, the player may be instructed to open one, two, three, four or five clues. See FIG. 5. The instruction may be to reveal a certain number of clues. For example, if the player's game piece is at the START block 51A, the intermediate block 51B or the intermediate block 51C, he or she is instructed to open any five, three or one clues, respectively. On the other hand, if the game piece lies on the game board 500 at a position corresponding to one of the pictorial instruction blocks 61, then specific clues are to be revealed.

Figure 6:
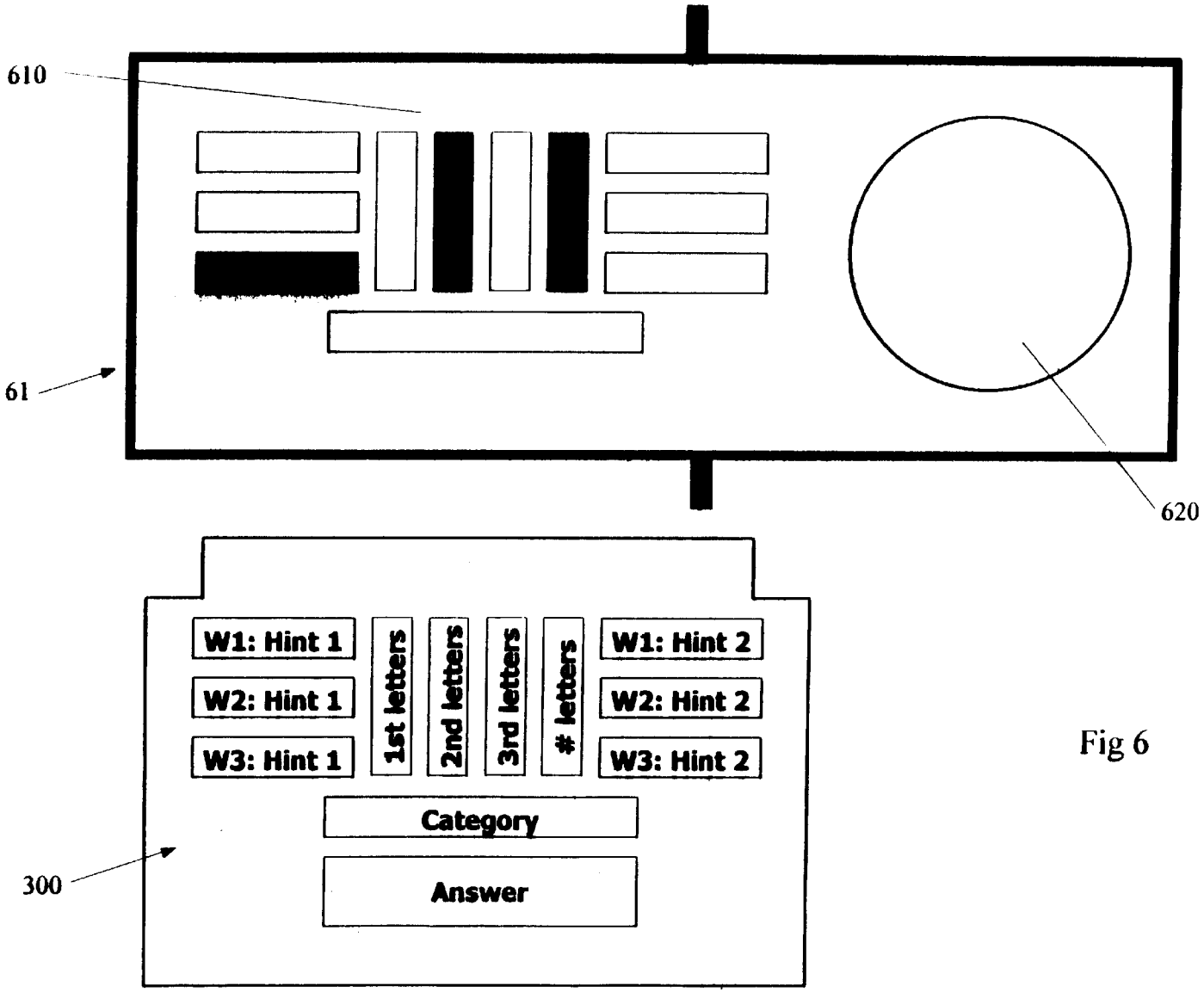
FIG. 6 shows an enlarged plan view of a portion of the game board next to a frontal view of the display apparatus, showing an exemplary pictorial instruction of the game board and how it positionally corresponds to the display apparatus.

FIG. 6 shows an enlarged plan view of a pictorial instruction block 61 next to a frontal view of the showcase box 300. Specifically, the pictorial instruction block 61 indicated by arrow A in FIG. 5 is shown in the enlarged view of FIG. 6. The eleven blocks 610 within the pictorial instruction block 61 positionally correspond in their arrangement with the top eleven windows of the showcase box 300. When occupying a pictorial instruction block 61, a player's game piece may be placed in a game piece block 620 within the block 61. The shaded, or otherwise highlighted, windows denote the clues which are to be revealed during the first turn. For example, if the player starting a round was at the location shown by arrow A on the game board 500, they would begin by pulling slides 83A, 85, and 87, revealing the clues in the corresponding windows 33A, 35, and 37 (see FIG. 3).

After revealing clues, the player then has the option to guess the answer to the puzzle card as long as time remains for his or her turn.

Other Turns in a Round

After the first player has completed his or her turn, the timing device is again activated. This measures the maximum time allowed for the turn. Then, there are three options for play. A player does not need to declare in advance which option he or she plans to follow.

OPTION #1: Reveal any single clue, and then do not guess. The player can study the board until time is up, or forfeit his or her right to guess during this turn and end his or her turn by saying "NEXT!". By so doing, the player reserves his or her right to guess later in the same round, provided that he or she gets another turn before another player correctly guesses the answer.

OPTION #2: Reveal any single clue, and then before time is up guess the answer to the puzzle card.

OPTION #3: Without revealing a clue, but before time is up, guess the answer to the puzzle card. Even if the guess is incorrect, no new clue will be revealed during this turn.

A player may not "pass." A turn is completed when:

(1) the time runs out without a guess being made

OR (2) a player has revealed a new clue and declares "NEXT"

OR (3) a guess is made and is determined to be correct or incorrect.

The round is completed when a correct guess has been made, or when every player has guessed incorrectly and/or no more clues remain. If only one player remains alive in the round, i.e., if there is only one player that has not yet formally guessed at the answer, then he or she may take only a predetermined number of additional turns, such one or two new turns, to solve the puzzle card. The number of such additional turns to be allowed should be determined prior to commencement of the game by mutual agreement among all players. If the last remaining player is unable to solve the puzzle within the predetermined number of turns, the round concludes and no one advances forward on the game board.

Guessing the answer to the puzzle card

After a player declares that he or she is making a guess, he or she writes down the three words or phrases comprising his or her guess. Then he or she alone will check the answer on the showcase box 300 by, for example, sliding open slide 80 to reveal window 30 (see FIG. 3). Spelling must be exact. If the guess is incorrect, then the player who guessed will assume spectator-only status for the rest of the round. If the guess is correct, then the player who guessed should advance his or her playing piece forward one space on the game board, with play then proceeding to the next round.

Other players can verify the spelling once a claim of correctness is made. If a player incorrectly claims correctness, then he or she must back down one position on the game board (instead of advancing). For less formal play, use an honor system when checking the answers, and/or allow spelling errors.

Challenges

After a round is completed, a player may challenge the puzzle card if they believe that another word from the category fits sequentially between the first and third words of the answer. If the challenge word is legitimate, as determined, for example, by checking a dictionary or other reference material or the like, then the player who made the challenge should also be allowed to move one space forward on the game board.

Alternate Playing Methods

One or more of the following play options may be implemented, if desired.

1) For paperless play, have guesses given orally, or use an honor system.

2) Allow spelling mistakes.

3) Use no time restraints.

4) Allow any player to guess at any time, with the player whose turn it is having the option to guess first if they like.

5) To play without the game board, players should keep any puzzle card that they guessed correctly.

For the first turn of a round, the lead-off player should reveal the number of clues determined by finding the difference between a predetermined target number and the number of cards that he or she has already won. For example, if the target number were seven and a player had won zero cards, he or she would open seven windows. However, if he or she had won three cards, he or she would open only four windows. Play until someone wins a specified number of cards. The specified number of cards may be agreed upon in advance and may, for example, be the same number as the above-mentioned target number. Alternatively, play until all cards in the stack have been won. In this case, the winner is the player with the most cards.

In electronically-implemented versions of this invention, the showcase box 300 may implemented as an interactive display, or "virtual showcase box", on an electronically-generated display such as a computer screen, a television screen, an electronic display apparatus or the like. In this case, the players may selectively open and close windows by communicating with the display apparatus via an input device. For example, a player may use a computer mouse, arrow keys and "enter" key of a keyboard, a touch-screen device or the like to select or de-select the window(s) he or she desires to open or close.

Additionally, in electronic implementations of the invention, a "virtual" game board 500 and game pieces may be displayed on a display apparatus between rounds of play, or may be selectively displayed as requested by the players. For example, if a player wishes to see the current status of the game board, he or she may activate a switch. For example, by using a mouse, arrow keys and "enter" key of a keyboard, a touch-screen device or the like, the player may activate a "toggle button" or the like displayed on the display apparatus along with the showcase box 300. This causes the display apparatus to display the virtual game board 500 and the position of the virtual game pieces on the board. When a player wins a round, he or she may advance his or her virtual game piece to a desired location on the game board using a conventional "drag-and-drop" technique with a mouse, by using the arrow keys and "enter" key of a keyboard, by using a touch-screen device or the like.

Alternatively, when a game of this invention is electronically implemented, the game board 500 can be eliminated and a display apparatus displaying a virtual showcase box can automatically open an appropriate number of windows, in a random configuration, at the beginning of each round.

While the invention has been described in conjunction with the specific exemplary embodiments described above, many equivalent alternatives, modifications and variations will become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

For example, while a puzzle answer described above has three words, more or fewer than three words may be included in a given puzzle answer. Additionally, more or fewer clue windows and associated clues may be provided than are depicted.

Additionally, while slides are used as clue-hiding devices in the depicted embodiments, it should be appreciated that alternative clue-hiding devices, such as hinged doors, flaps or the like, may be used. Moreover, while some of the windows and slides in the depicted embodiments positionally correspond to more than one clue, it should be appreciated that a separate window and/or slide may be provided for each individual clue.

What is claimed is:

1. A word puzzle, comprising:

a puzzle answer comprising a plurality of words or word phrases that are sequentially adjacent within a given reference list; and a plurality of clues, each clue hinting at at least one of the words or words phrases of the puzzle answer.

2. The word puzzle of claim 1, wherein the word puzzle has a structure that allows simultaneous viewing of all of the clues.

3. The word puzzle of claim 2, wherein the structure that allows simultaneous viewing of all of the clues comprises an indicia-bearing substrate containing all of the clues.

4. The word puzzle of claim 2, wherein the structure that allows simultaneous viewing of all of the clues comprises an electronically-generated display that can simultaneously display all of the clues.

5. The word puzzle of claim 1, wherein the word puzzle has a structure that allows simultaneous viewing of all of the clues and the puzzle answer.

6. A word puzzle game, comprising:

at least one word puzzle according to claim 1; and a clue-hiding system that selectively conceals and reveals each clue and the puzzle answer.

7. The word puzzle according to claim 1, wherein the clue-hiding system comprises:

a plurality of clue windows positionally corresponding to the clues; and a plurality of clue-hiding devices that selectively cover and expose the plurality of clue windows, each clue-hiding devices being selectively openable to expose at least a portion of a clue window.

8. The word puzzle according to claim 7, wherein the clue-hiding system further comprises:

an answer window positionally corresponding to the answer; and an answer-hiding device that selectively covers and exposes the answer window.

9. The word puzzle game according to claim 6, further comprising a game board that tracks progress of players over multiple rounds of play.

10. The word puzzle according to claim 9, wherein the game board provides at least one instruction that instructs a player to manipulate the clue-hiding system to reveal at least one clue.

11. The word puzzle according to claim 10, wherein the at least one instruction is a pictorial instruction.

12. The word puzzle according to claim 11, wherein the pictorial instruction comprises at least one indicia arranged in a pattern correlated with a positional arrangement pattern of at least one of the plurality of clues, the pattern of the at least one indicia indicating at least one clue that is to be revealed.

13. The word puzzle of claim 1, wherein the reference list is ordered according to one of alphabetical order, chronological order, as-published order, and particular rank order.

14. A word puzzle game, comprising:

a word puzzle comprising a plurality of clues;

a clue-hiding system that selectively conceals and reveals each clue; and a pictorial instruction comprising at least one indicia arranged in a pattern correlated with a positional arrangement pattern of at least one of the plurality of clues, the pattern of the at least one indicia indicating at least one clue that is to be revealed by manipulating the clue-hiding system.

15. A method of playing a game, comprising:

providing at least one word puzzle according to claim 1;

preparing the word puzzle for play by concealing at least one of the plurality of clues and concealing the puzzle answer, revealing at least one clue if all of the clues are concealed; and guessing at the answer based upon at least one revealed clue.

16. The method according to claim 15, further comprising revealing the puzzle answer after guessing at the answer has been performed.

17. The method according to claim 15, further comprising successively revealing concealed clues.

18. The method according to claim 15, further comprising instructing a player to reveal at least one clue.

19. The method according to claim 18, wherein the instructing the player to reveal the at least one clue is performed using a pictorial instruction.

* * * * *